United States Patent [19]

Hepp et al.

[11] Patent Number: 4,852,005

[45] Date of Patent: Jul. 25, 1989

[54] METHOD OF COMPUTING FORMATION DIP AND AZIMUTH

[75] Inventors: Vincent R. Hepp, Houston, Tex.; John A. Duffy, Broken Arrow, Okla.

[73] Assignee: Amoco Corporation, Chicago, Ill.

[21] Appl. No.: 35,818

[22] Filed: Apr. 3, 1987

[51] Int. Cl.[4] ..... E21B 49/00; G01V 3/08

[52] U.S. Cl. ..... 364/422; 324/333; 73/152

[58] Field of Search ..... 364/422; 73/152; 324/333

[56] References Cited

U.S. PATENT DOCUMENTS

| | | | |
|---|---|---|---|
| 4,316,250 | 2/1982 | Vincent | 364/422 |
| 4,348,748 | 9/1982 | Clavier | 364/422 X |
| 4,355,357 | 10/1982 | Chan | 364/422 |
| 4,453,219 | 6/1984 | Clavier | 364/422 |
| 4,638,254 | 1/1987 | Uhri | 364/422 X |

*Primary Examiner*—Jerry Smith
*Assistant Examiner*—Steven Kibby
*Attorney, Agent, or Firm*—Scott H. Brown; Fred E. Hook

[57] ABSTRACT

A dipmeter signal processing method and system are disclosed, wherein portions of at least three are matched, utilizing correlation intervals, to derive a plurality of possible offsets. For each of the offsets, the spatial coordinates are defined of an associated vector parallel to an implicit bedding plane. The coordinates are utilized to combine nonparallel vectors to generate a plurality of dips. The dips that substantially repeat for a given depth or repeat from one depth level to the next within a given depth zone are retained to retain a single dip for each depth. A display is then outputted of each dip at each depth.

13 Claims, 8 Drawing Sheets

PEARSON PRODUCT MOMENT $$r = \frac{\bar{A} \bullet \bar{B}}{|\bar{A}| \times |\bar{B}|}$$

MATRIX INVERSION METHOD

VECTOR ANALYSIS METHOD $$\triangle = \begin{vmatrix} (X_2 - X_1)(Y_2 - Y_1) \\ (X_4 - X_3)(X_4 - X_3) \end{vmatrix}$$

NULL DETERMINANT INDICATES THE PADS ARE PARALLEL AND A DIP CANNOT BE COMPUTED

EQUAL AREA PARTITION $R = \sqrt{1-\cos\theta}$

DIPMETER SYSTEM

METHOD OF COMPUTING FORMATION DIP AND AZIMUTH

BACKGROUND OF THE INVENTION

1. Field of the Invention

The present invention relates generally to a method used in processing dipmeter well logs and, more particularly, to new techniques for automatically computing the slope (dip) and direction (azimuth) of subsurface formations. This information is of particular importance in the exploration for natural resources, such as oil and gas.

2. Setting of the Invention

As is well-known in the art, a dipmeter tool is suspended within a wellbore and is passed along the rock face within the wellbore. The dipmeter tool produces signals from several directionally sensitive sensors spaced around movable arms extending from the tool. The signals are processed to allow the log analyst to infer the type of rock around the borehole and the angle and direction of the bedding planes. In particular, most dipmeter tools record variations in electrical conductivity from circumferentially spaced receptors or sensors, the location of the tool in the borehole, and sufficient other information to permit the location of the tool within a geologically meaningful, spatial reference system.

In the prior art, the computer programs required to process the recorded signals from a dipmeter tool were quite specific, i.e., a computer program was written in a manner such that the program could process the signals from only a particular type of dipmeter tool. There is at least one processing system for each tool, and the development and use of a new dipmeter tool required a new processing system. Frequently, these processing systems are incompatible with prior tools, even those made by the same company. Sometimes several different processing systems have been developed to one tool. With many tools, and a multiplicity of processing systems, the answers derived from these systems do not agree with each other, so that there is a need for a dipmeter processing system that is universal in its applicability.

Prior art dipmeter processing systems are generally shown in U.S. Pat. Nos. 4,303,975; 4,320,458; 4,357,660; 4,414,656; and 4,541,275. The most relevant prior art dipmeter processing systems to the present invention are disclosed in U.S. Pat. Nos. 4,348,748 and 4,453,219; however, none of these patents disclosed or suggest a dipmeter processing system that is capable of processing the dipmeter signals from any tool by modeling the particular tool's configuration to be used in dip computation. Other differences between the present invention and the relevant prior art dipmeter processing systems will be mentioned throughout this disclosure below.

SUMMARY OF THE INVENTION

The present invention is contemplated to overcome the foregoing deficiencies and meet the above described needs. Specifically, the present invention is a dipmeter signal processing method and system wherein portions of at least three dipmeter signals are matched utilizing correlation intervals to produce a plurality of possible offsets. For each of the offsets, the spatial coordinates of an associated vector parallel to an implicit subsurface bedding plane are defined. The coordinates are then used to combine nonparallel vectors to generate a plurality of dips. The dips that repeat for a given depth or repeat for one depth level to the next within a given depth zone are then retained to produce a single dip for each depth. A display is then generated illustrating each dip at each depth, such as in the form of the well-known "tadpole" dipmeter plot.

Specifically, the present invention encompasses a method of resolving directionally sensitive signals from the sensors on the tool in a fashion which allows the user to process signals from any tool with the same processing system. This capability not only reduces the number of processing systems which have to be developed, but also allows the user to compare the results from different tools with the assurance that all the data has been processed in the same manner. Also and very importantly, incorporated within this processing system are features which improve the accuracy of the dip computation and analysis, which will be described below.

DETAILED DESCRIPTION OF THE PREFERRED EMBODIMENTS

The present invention comprises a dipmeter signal processing method, wherein portions of at least three dipmeter signals are matched, utilizing correlation intervals, to derive a plurality of possible offsets. Each of the offsets represents a vector which is parallel to a subsurface bedding plane. For each of the offsets, the spatial coordinates of an associated vector perpendicular to a subsurface implicit bedding plane are defined. The coordinates are then utilized to combine nonparallel pairs of dipmeter sensors to generate a plurality of dips. Those dips that repeat for a given depth or repeat from one depth level to the next within a given depth zone are retained to produce a single dip for each depth. A list of each dip at each depth is then prepared.

Figure 1:
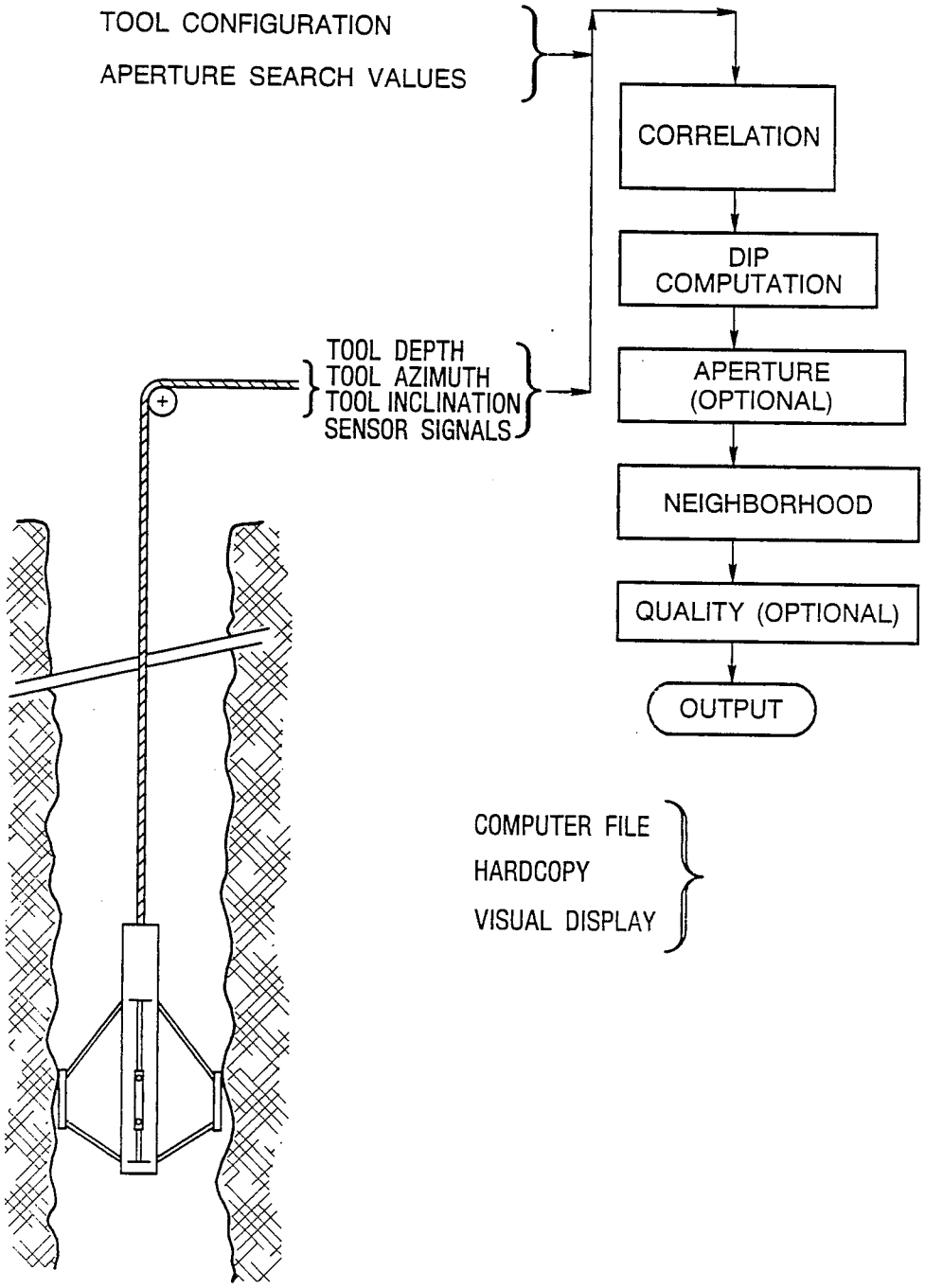
FIG. 1 is an illustration of a dipmeter tool suspended within a wellbore and a block diagram of one dipmeter processing method of the present invention.

As shown in FIG. 1 and is well-known in the art, a multiarm dipmeter tool is suspended by a multi-channel wireline within a wellbore and is moved upwardly through the wellbore to produce electrical signals representative of the resistivity of the formation through which the wellbore penetrates. Other electrical signals from the dipmeter tool include tool depth, tool azimuth, and tool inclination. These signals are recorded, usually on magnetic tape, for latter processing. The system of the present invention addresses the computation of dips from the above signals, and some method of reading signals from the recording tapes into a data management system is utilized. Preferably, such a data management system will make data from different tools appear identical to the processing system. Any of several commercially available database systems, such as RIM or DB2, can be used to fulfill this function. Also, this data management system can be used in conjunction with a log analysis system responsible for reading input data for analysis, storing data during the analysis, and presenting the output from the system to the user in whatever form the user requests.

As was outlined above, a dipmeter tool records electrical or other types of signals from directionally sensitive sensors spaced about movable arms extending radially from the tool. As the individual sensors pass formations traversed by the wellbore, the signals from these sensors change, and from these changes the log analyst can infer certain qualities about the formation. More importantly for the dipmeter analysis systems, the depths of the channels are also recorded. As each of these sensors passes the formation, the depth at which the formation is encountered is recorded, and the depth on one side of the wellbore is compared with the depth at another position in the wellbore, and from these resulting "offsets", a processing system can determine the angle of the formation about the tool. Since the tool also produces a signal of the location of the tool in "earth coordinates", that is, with respect to the center of the earth and magnetic or true north, if the angle of the formation with respect to the tool is known, as well as the location of the tool, the angle and direction of the formation can be calculated in "earth coordinates", to produce an indication called the dip, as is well-known to those skilled in the art.

The processing system of the present invention can be more easily understood by it being broken into five blocks, which will be described individually in detail below; the blocks are:

1. Correlation
2. Dip Computation
3. Aperture (Optional)
4. Neighborhood
5. Quality (Optional)

Correlation

Figure 2A:
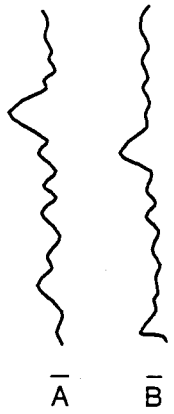
FIG. 2*a* is an illustration of two dipmeter curves and a method used to determine the quality of the correlation between the two curves.

The word "correlation" means the detection and evaluation of the degree of agreement between two sets of data. Correlation is a method of obtaining the offset, the initial datum for entry into the processing system. Within one embodiment of the present invention, this agreement is expressed as a Pearson Product Moment Correlation, shown in FIG. 2*a*. Any of several methods of obtaining offsets can also be used, such as statistical curve fitting, curve analysis and point-by-point pattern matching. Whatever the specific method used, the correlation procedure expresses the degree of agreement between two curves at a given point numerically, so that the processing system can determine that two sets of data are more like each other at one place than another.

Since the dipmeter signals can be obtained from the sensors in analog or digital form, read and stored by the well log analysis system mentioned above, the processing system of the present invention selects any curve as the standard, that is, the "base curve", and any other curve as the curve to be correlated with the base curve. Thus, curves from adjacent sensors on the same tool pad, between adjacent tool pads, or in any other predetermined or user selected order can be used, subject only to the condition that the processing system be able to determine the exact location of sensor that made the signal, as will be described below. This flexibility in user definition is not available in the prior art processing systems.

Figure 2B:
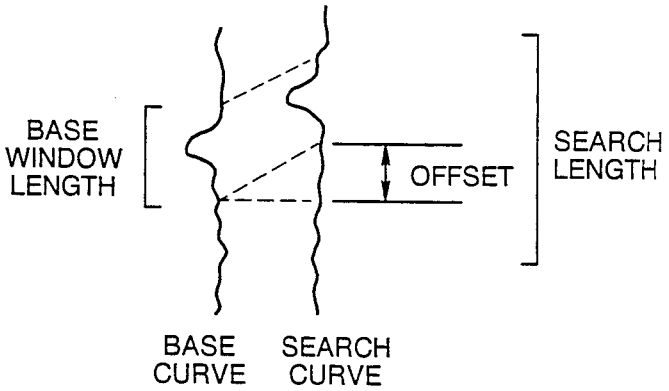
FIG. 2*b* is an illustration of two dipmeter curves and the base window length vs the research length, as well as the depth offset of the correlation fit of the two curves.
Figure 2C:
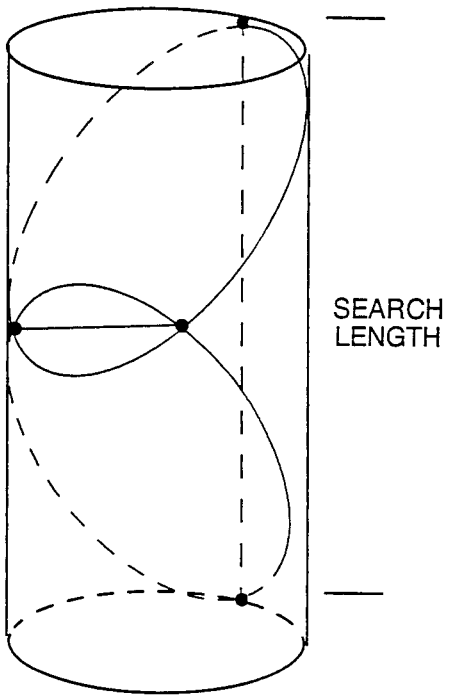
FIG. 2*c* is an illustration of how search length is related to maximum and minimum expected offsets and how the offsets are displayed on a correlogram.
Figure 2C:
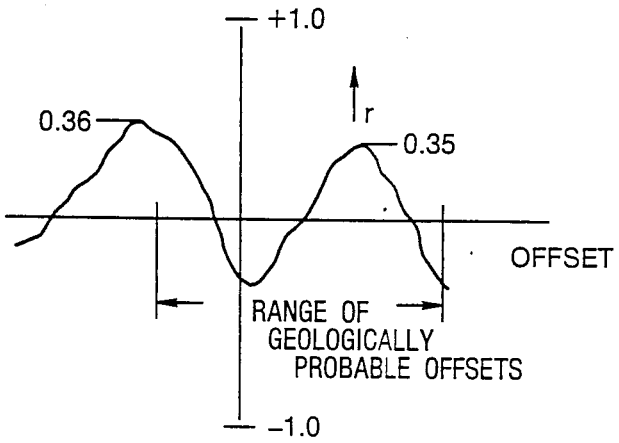

A segment of the base curve is chosen, and a matchable segment is sought within a search length on the search curve. When such a segment is found, a correlation has been established. Two quantities characterize the correlation: the "goodness" of fit of the base segment to the search segment, called an 'r-value', and the vertical distance of displacement, called 'offset' of the search segment with respect to the base segment, as shown in FIG. 2*b*. The process is repeated across a user defined search window until a full list of r-values and offsets are obtained. For any combination of base and standard curves, a list or plot of offsets or 'r-values' is called a "correlogram", as shown in FIG. 2*c*, which is well-known to those skilled in the art.

The base curve window length is a matter of user choice, and as a rule of thumb, it should be large with respect to both the transverse distance between the tool sensors and the measured offsets between curves, but it should be small enough so that any errors caused by tool rotation remains negligible within the window. Experience shows that changing the length of the window has little or not effect on the measured offset. Consequently, in many cases, identical dip values can be obtained from short lengths as from long lengths, over the same curve pair. On the other hand, measured r-values increase as window length decreases leading to a decrease in the quality of short length correlations, since many correlations of poor inherent quality pass a minimum required r-value test. In practice this base segment length is frequently from about 2 to about 10 ft and preferably about 4 to about 8 ft, but smaller and larger windows can be used as circumstances dictate.

The search length covers the minimum and maximum expected offset, which can be back-calculated from the relationship between the maximum expected dip, the well-bore deviation, the wellbore diameter, and the location of the sensors within the wellbore, as is well-known in the art. Generally, the search length can be from about 1 ft to about 6 ft.

The r-values on the correlogram vary between $-1.0$ and $+1.0$, and the correlogram exhibits at least one peak over the search length. If the search segment is identical in shape to the base segment, the r-value reaches exactly 1.0 at the true curve offset. For any other offset, the r-value is less. If the search curve is periodic, the value of 1.0 occurs repeatedly at every offset of one period. If one of the two curves is perturbed by noise, the correlation value never reaches 1.0. On the other hand, the correlogram can, and most frequently does, exhibit more than one peak.

In the prior art dipmeter processing systems, the highest of such multiple peaks on a correlogram was chosen as the true correlation, regardless of other peak values. This practice is questionable in the frequent situation where all peaks have substantially the same r-values. For example, there exists no substantial reason to prefer a correlation of r-value 0.36 to an alternative one of r-value 0.35. Moreover, situations do arise when the user, because of some external geological information, can determine that only dips in a certain direction have geological meaning.

In the present system all the correlations are scanned, all peaks detected, all evaluated, and all stored, and only then is any preselected range of r-values checked. Peaks are only retained if, considering the correlogram as a whole, the peak within the user defined valid range is among this arbitrary number of retained peaks, which have been selected and ranked according to the correlation values. Therefore, the present invention permits greater accuracy in dipmeter analysis over that offered by prior art processing systems. For the present, it is sufficient that the reader understand that several possible offset values, i.e., peaks on the correlogram, are retained for further evaluation by the system.

At one depth, all available signals can be correlated or some subset of all the available signals can be correlated. The order in which the signals are correlated is arbitrary, and there is no requirement that all the calculated offsets to be used at one depth be calculated before moving onto the next depth. The data is calculated from a selected set of signals before moving onto the next level, but this is not a requirement. The set of resulting offsets and r-values constitutes a 'round' of correlations for that level. Having completed a round, the process starts another one, and another, etc., until all the available data has been processed or the subset of that data (the user has requested) has been processed.

Although practical considerations limit the number of curves which can be processed at any one time, the present system is designed to allow the user to correlate one set of curves, then go back and correlate another, etc. On one embodiment, when the correlation process completes the data set containing all of the offsets, the analysis phase (Dip Computation section) combines vectors produced by all the runs at one depth into a single matrix, and analyzes the entire group as if all had been produced at one pass. This avoids computer processing and computer memory core restrictions and allows the user considerable flexibility in the analysis of the data.

Although it has been known for some time that the accuracy of dipmeter computations can be enhanced if overlapping windows are correlated, in the prior art processes no firm guidelines were disclosed about how much the next window should overlap the former one. An integral part of the present invention is to provide considerable overlap from window to window because valid correlations tend to persist through a change of window length. Similarly, valid correlations persist through overlapping windows of the same length, carrying constant curve offsets, while poor correlations tend to produce random offsets. Overlaps of from about 10% to about 70% of the window length can be used, but overlaps of from about 20% to 30% of the window length are preferred.

Pairs of correlations measured between three or more curves such that the plane of the trajectories of the first pair intersects the plane of the trajectories of a second pair are hereafter called 'intersecting pairs'. Nonintersecting pairs are located in parallel planes, and their relative offsets cannot determine a dip. The processing system of the present invention identifies and eliminates such parallel pairs. This also allows the processing system a great deal of flexibility in selecting curves to be processed in a correlation because the user need not consider whether a given combination of vectors is valid; the processing system will test each combination and discard any invalid ones. To this end in the prior art, two curve combination methods have been used. One is where only triangular combinations, of the type 'adjacent curve—common curve—adjacent curve' are acceptable, tying the computed dip to the common curve with the offsets representing partial derivatives of the subsurface bedding along the common curve. Another method is where diagonal combinations are used to define planar directions, as opposed to triangular combinations which are thought to define physical planes.

In the present invention the distinction between triangular and diagonal or quadrangular combination vanishes. In effect, all combinations are regarded as quadrangular and of any shape except quandrangles degnerated into straight lines. Triangles are treated as special quadrangles where two apices are fused into one. Except for the requirement of nonsingularity, there are no requirements in the processing system of symmetry in the positions of the sensors, nor of common reference plane, as long as sensor positions are known. This generalization allows the progam to derive dips from any combination of sensors, provided their locations in space at the time of recording are precisely known.

In the prior art, three and more electrode tools are discussed above, wherein all the depth measurements are kept with respect to each other as the tool is moved up (or down) the wellbore. That is, the measurement for one curve at any given depth is recorded at the same time and at the same depth as the other curve stated to be at that depth. For many of the newer multiple sensor tools, this is no longer true because often the sensor is at the end of a flexible arm, and the true depth varies from the stated depth as a function of the extension of the arm. Moreover, the relationships between the tool axes and the sensors have changed; that is, the sensors are on the end of the tool arm on the center line of the arm on the older tools; however, on newer tools this depends on tool design. However, this does not matter to the processing system of the present invention because a mathematical model of the dipmeter tool configuration is determined so that the precise locations of the sensors can be established and used for correlation and determination of offsets. The mathematical model defined by the user takes into account the length of the extendable arms of the tool, the radial distance between sensors, as well as the vertical distance between sensors.

Dip Computation

Figure 3A:
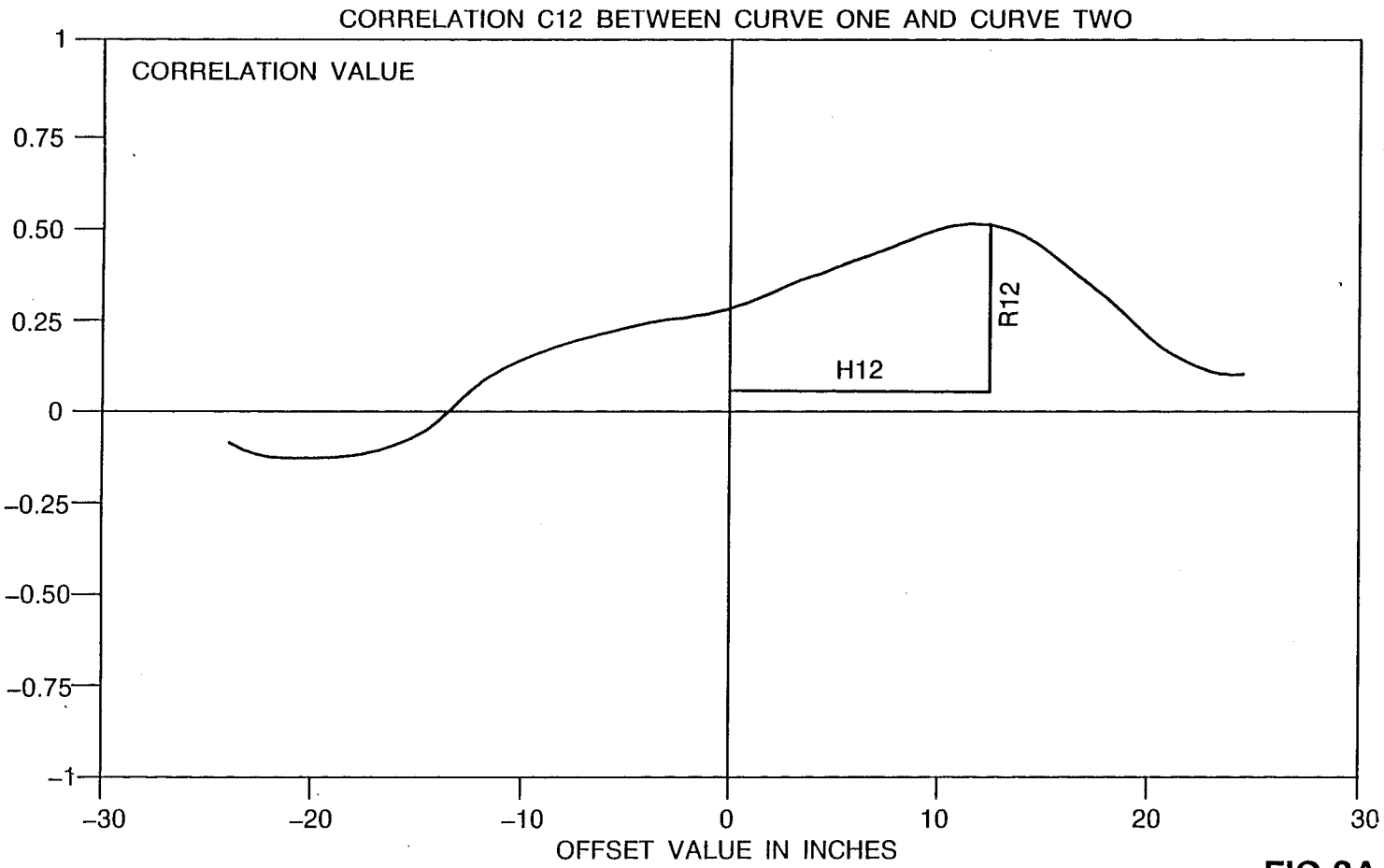
FIG. 3*a* is an illustration of one embodiment of the dip computation method of the present invention.

Given the offsets between two pairs of curves at a given depth, the computation of the associated dip requires the additional knowledge of the positions in three-dimensional space of the sensors, as stated above. If, as is often the case, but not necessarily, one curve is common to both pairs, then the positions of only three sensors is required. In the present invention, the dip derivation procedure will first be described in geometrical terms, and then in algebraic terms easily converted to algorithms for use within a computer program. For example, as shown in FIG. 3A, consider a correlation labeled C12 between curve 1 and 2. It consists of two numbers, R12 and H12. R12 characterizes the goodness of the fit between curves 1 and 2 when curve 1 is displaced by H12 with respect to curve 2. By design, R12 is a maximum value for the "peak" of the abscissa of H12. By convention, if the first curve is moved upwards to match the second, or otherwise stated: if curve 1 is "down" with respect to curve 2, then H12 is positive, it is negative otherwise or null.

Consider the two correlated segments in their original positions on their sensor trajectories: each point of the base segment has a counterpart on the search segment, and the vector joining both points is called a "correlation vector". All such correlation vectors along the correlation interval are parallel and equal, according to the assumption that sensor trajectories are parallel and equal through the correlation interval. Three components constitute a correlation vector labeled V12: two are in the plane perpendicular to the tool axis, solely dependent on the positions of the sensors, and the third parallel to the tool axis and equal to H12. Similarly, three components define correlation vector V34, two in the normal plane; the third equal to H34.

From any point within the correlation space two vectors can be drawn parallel to V12 and V34, respectively, defining between themselves a plane parallel to the formation bedding originating the two correlations. Note that in this approach, the actual bedding plane is not reconstructed at its depth, if any such exists, but a plane direction characterisic of the correlation interval is defined.

Figure 3B:
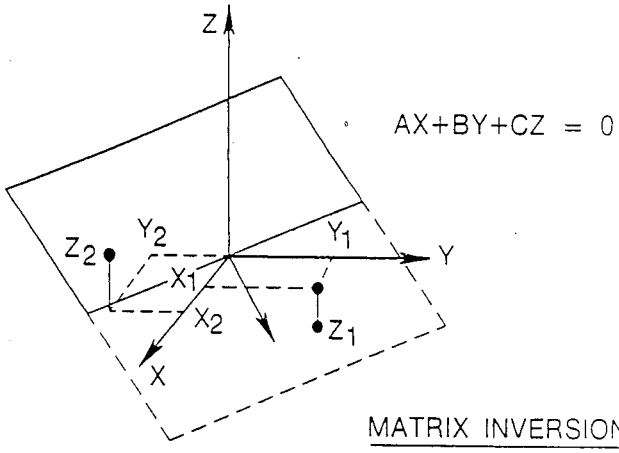
FIG. 3*b* is an illustration of two alternative methods of defining a plane parallel to the formation bedding originating the two correlations.
Figure 3B:
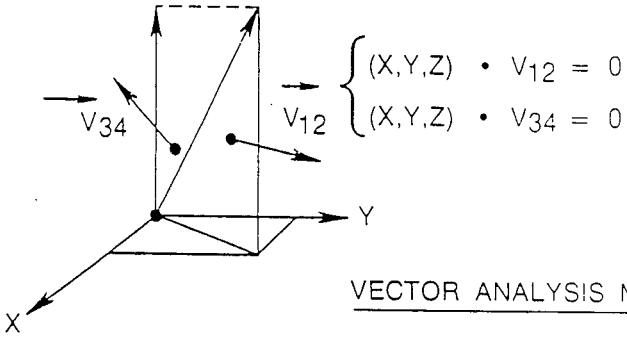

As shown in FIG. 3*b*, algebraically, two approaches can be used to reproduce the above described geometric procedure, one derived from analytic geometry, the other from vector analysis. In the first approach, assume some reference frame (OX, OY, OZ) within which the general equation of a plane is written. The matrix of coefficients A, B, and C is inverted to equate the differences of Z values to H12 and H34, respectively, at sensor coordinates (X1, Y1), (X2, Y2), (X3, Y3) and (X4, Y4). Since the X, Y, and Z coordinates appear only through their differences, the choice of the origin of coordinates is immaterial.

In the vector analysis approach, again noting that coordinates appear only through their differences, the components X, Y, and Z of the unknown dip vector are written, and this vector is written as being perpendicular to the dip plane and perpendicular to all vectors contained in that plane and, in particular, to correlation vectors V12 and V34. This condition is expressed as the simultaneous null dot products:

$$(X, Y, Z) \cdot V12 = 0$$

$$(X, Y, Z) \cdot V34 = 0$$

Both approaches lead to a determinant appearing in the denominator of the expressions of components X and Y. If this determinant is null, X and Y are indeterminate; this condition occurs exclusively when correlations 1-2 and 3-4 are nonintersecting. A null determinant is tested for and the processing system automatically eliminates such sensor combinations from the calculation step. In one embodiment, both approaches are utilized; if either indicates that the vectors are parallel, the combination is rejected. The X and Y coordinates of the sensors are derived directly from the data sent uphole from the dipmeter tool. The Z coordinates normally include both the axial displacement of the sensor from its rest position because of its particular arm linkage configuration and the measured offset H12. As stated earlier, to allow the processing system to calculate a dip from a given pair of offsets, the processing system first constructs a mathematical model of the operating characteristics of the device. This model does not have to mimic all the response characteristic of the tool, but contains sufficient information to enable the processing system to specify the location of the source and search sensors for each of the offsets. The location of a base or reference sensor is taken to be the midpoint of the base window.

A triangle can be constructed by drawing a line from the reference sensor to the search sensor, with the second leg of the triangle passing through the location of the search sensor at that depth, and one offset in length, either up or down the wellbore depending on the direction of the offset, and parallel to the tool axis. A line drawn from this point in space back to the midpoint of the window represents a vector parallel to a subsurface bedding plane detected by the correlation process. A similar process is repeated for the second offset to obtain a second vector. At this point the processing system has defined two vectors in a three-dimensional space, and using conventional analytical algebra techniques determines a plane.

One analytical algebra technique involves drawing a line from either end of the first vector parallel to the second vector. Any arbitrary point along this second vector can be selected, and this point, along with the initial end points of the first vector, gives three points in three-dimensional space. This results in a set of three simultaneous equations with three unknowns, and using Cramer's rule, as is well known, among other methods, can be used to solve for the equation of the plane. Having determined the one plane in which all three points lie, and line can be drawn which passes through the tool origin and is perpendicular to this plane. The direction cosines of this line are the dip vectors in a Cartesian space.

Another possible technique takes advantage of the fact that if a dip vector plane exists, it must be simultaneously perpendicular to both of the vectors described above; that is, the dot-product of these two vectors must equal 0.0. If any such plane exists, there are an infinity of planes, and for convenience, the plane passing through the origin can be used. Again, as above, the direction cosines of a line perpendicular to this plane are the dip vectors in a Cartesian space.

In both of the cases above, detection of parallel lines, which do not produce dips, takes advantage of the fact that the determinants of the matrices produced in both cases go to zero when the lines are parallel and are discarded from the solution. This allows the processing system to use any of the sensors in any relationship to each other since the processing system no longer, as was the case in the prior art, has to know ahead of time whether a given sensor combination is valid or not.

In the above-discussion, tool space and geological space or any other space can be used to express the location of the points involved. Usually a transformation is made from tool space, in which the data is usually recorded, to geological space, in which the dips are usually reported to the user. Since the vector solutions described above depend only on the location of the vectors in space, it is immaterial to the solution which coordinate system is used to represent the points because the answer will be the same point. In other words, if the coordinates are expressed in geological space, then the resulting dip will be expressed in geological space, i.e., "true dip"; if the coordinates are expressed in tool space, the resulting dip will be expressed in tool space and transformed to geological coordinates (using a linear three-dimensional rotation) before being output to the user.

From this discussion, those versed in the art can understand that, given sufficient information from the signals form the dipmeter tool to determine the location of the sensors in space, the same processing system can be used to determine dips from any tool. Since all tools return a dip in geological space from the calculation section of the processing system, the analysis section does not need to be aware of the particular device from which the dips were obtained, and thus will process dips from all tools identically.

It should be noted, while both the calculation of the dips themselves and the analysis of the dips from different vector combinations are both covered within the scope of the present invention, the calculation section can be used within a variety of other analytical techniques and still allow the comparison of different dipmeter tools.

Aperture (Optional)

As each dip is computed, it can be reviewed during the Aperture process for geological acceptability. Since the correlogram developed for the comparison of a base curve to a search curve often presents several peaks, when two such peaks are of comparable magnitudes, there exists no intrinsic reason to select one rather than the other. The existence of a peak manifests some geological phenomenon, but its interpretation in terms of dip is ambiguous. From the discussion of dip calculation, a single vector taken alone is meaningless; it is the combination of two vectors to produce a dip that has meaning within this context; there is no way to determine whether a given set of possible offsets, by themselves, have any meaning in the processing system. Therefore, the present invention provides a way for geological information to be used in the processing system.

In Aperture, the user defines a probable dip, by its magnitude and its azimuth, and a probable variation about that dip. Since this procedure is optional, a default value will be supplied by the system if it is not set by the user. In prior art systems, the probable variation has been used under the term of 'Search Angle', and the probable dip was implicitly assumed to be horizontal or perpendicular to the course of the wellbore. In the present invention the user can choose the probable variation in complete freedom, thereby providing greater flexibility and finer, more accurate results.

Aperture is used within the dip calculation phase after the two vectors to be processed have been selected. Each possible offset from one vector is linked will all possible offsets from the second vector, producing $n^2$ possible offset pairs, where n is the number of offsets retained for each vector, For example, n can be greater than or equal to one. Retaining three offset peaks for each vector has produced acceptable results. These possible offsets are ranked in descending order by the average of their correlation coefficients, and the dip from that offset pair is calculated. If this dip falls within the area on a hemisphere defined by the expected dip azimuth, expected dip magnitude and search angle, then this dip is returned to a calling routine; otherwise, the system selects the next possible offset pair and tries again. If all the combinations are exhausted, the calling routine provides a missing data marker for the dip. If the dip calculation routine determines that the set of vectors is collinear and cannot produce a dip, then it is sent to the calling routine with missing data values supplied for the dip azimuth and magnitude values.

It should also be understood that the user's specifications can vary greatly. If, for example, the user allows the program to default to an expected dip magnitude of 0, an expected dip azimuth of 0, and a search angle of 60°, this allows the selection of dips with any azimuth from 0° to 60° in magnitude. In fact, setting the search to 90° would cause the routine to automatically take the highest correlation value in all cases since all dips would be acceptable, within calculation error limits. Since the routine is only selecting offsets from a predetermined list, which is developed by the correlation section, if the user chooses an inappropriate hypothesis, the program will find no offset combinations fulfilling the request and simply return a "missing data" message. Aperture assures the user that the best available combination of offsets was used within the processing system, as well as circumventing the problem produced in dealing with multiple sensor tools, where produced vectors are of wildly varying lengths, the spacing between the sensors varies widely, and where what might be an acceptable offset with one pair of vectors might produce grossly aberrant results with another. Finally, in making this Aperture process an option separate from the dip calculation process, the same procedure can be used for all tools since this process only deals with computed dips while how the dips are computed is dealt with by other sections within the processing system.

Neighborhood: Selection and Evaluation of Dips

The steps in the system outlined above permit the definition of many dips. For instance, if eight sensors are used, 28 unique vector combinations can be correlated, resulting in 378 possible dips at each depth; since each vector combination can be correlated two ways, that is, from Pad 1 to Pad 2 or from Pad 2 to Pad 1, there are 56 possible vector combinations, resulting in a possible 1596 dips at each depth. Even though these situations are theoretically possible, and can be used in cases of extreme interest, in practice adequate resolution can be obtained with smaller data sets. In one embodiment of the present invention, 16 vectors are correlated, 120 dips calculated, of which 8 are found to be collinear, resulting in 112 valid dips at each depth. The problem at this point is two-fold: first, to determine the importance (weight) of each individual dip, and then to determine the value and importance of the one dip to the output to the user at that depth.

In the prior art systems, the dip selection process was executed in the tool reference, and the selected dip was then converted to the Earth's reference. In the present invention, all dips are immediately converted to the Earth's reference, and the selection process is carried out in that reference. One advantage of this procedure is to eliminate the need to refer the dips to an average tool reference over the selection interval.

In Neighborhood, the individual dips are first weighted according to the correlation coefficients used to obtain the vectors used in the dip computations, but since each such dip determination results from the combination of two correlations, dips are given a weight of 3 if both r-values exceed 0.7, a weight of 2 if the lowest correlation value is between 0.7 and 0.3, and 1 if the lowest value is below 0.3. Although the theoretical range of the correlation coefficient is from +1.0 to −1.0, the procedure which retains correlogram peaks (offsets) discards any peaks which are negative values.

Figure 4A:
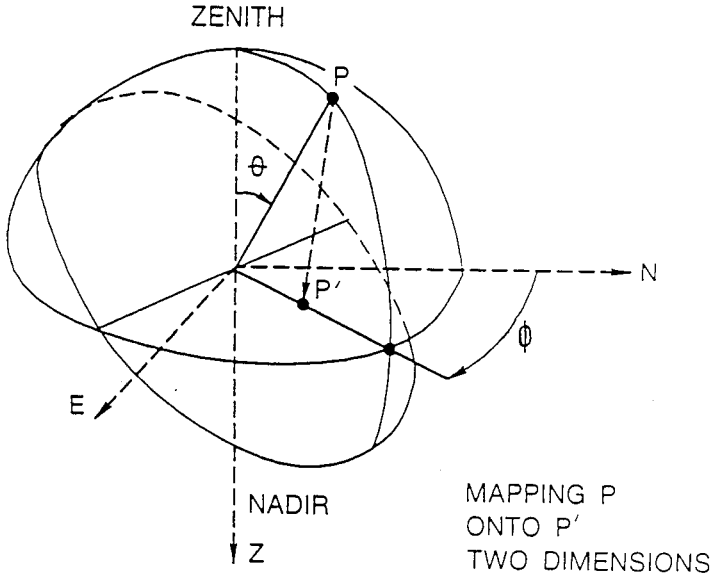
FIGS. 4*a* and *b* are illustrations of mapping a dip onto a unit reference hemisphere and then onto two dimensions.

As is well-known in the prior art, it is convenient to represent a dip as a point P on a unit reference hemisphere, as shown in FIG. 4*a*. Consider the well-known geophysical reference trihedron of arbitrary origin Omega, with Axis X pointing north, Y pointing east, and Vertical Z pointing downwards. Consider the upper hemisphere of unit radius centered at Omega. The angular distance from Zenith to point P is the dip magnitude Theta, and the angular distance from the north meridian to the meridian passed through point P is the dip azimuth Phi. Conversely, given any pair of numbers for dip magnitude and azimuth, respectively, in degree units for instance, one point P and only one represents that dip value on the hemisphere. A plane perpendicular to radius Omega-P represents the corresponding bedding plane without ambiquity.

Note that the Zenith point represents a flat dip, and a small variation of the position of a point near the Zenith can result in a large variation of its azimuth. Note also that the range of azimuths is between negative and positive infinities, with 0° to 360° as the practical range, while the range of magnitude is limited between 0° and 90°.

Figure 4B:
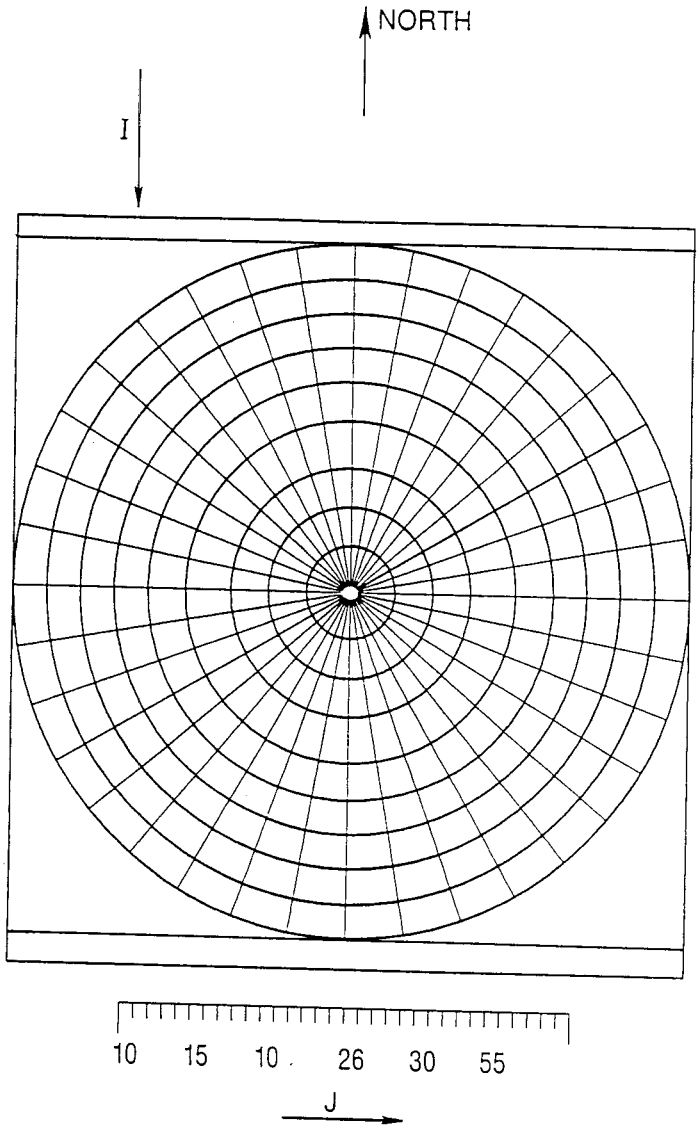

The hemisphere is then mapped onto an equatorial plane, as is well-known to those skilled in the art, such as a Wolfret transformation or a Schmidt transformation. Using a Schmidt transformation, the hemisphere can be circumscribed by a polygon, and the interior area of this polygon can be further subdivided into multiple polygons of smaller, yet equal areas. Thus, each subdivision corresponds to a similar, though distorted, area on the sphere. The subdivision can be carried out over the entire sphere, the distortion being barely perceptible near the Zenith, more notable about the equator, and considerable, though finite, around the Nadir. For one embodiment of the present invention, the 90° equatorial circle is circumscribed by a simple square, rather than polygons subdivided into an arbitrary number of smaller squares. This number, most conveniently chosen as an odd integer, will hereafter be called the Partition number, and denoted 2N+1, as shown in FIG. 4*b*.

Each unit area within the partition is called a "cell" and can conveniently be referred to by is Row and Column addresses I and J, respectively. The address of the cell containing a given dip of magnitude Theta and azimuth Phi can be calculated through the equations:

$$R = \sqrt{(1 - \cos(\text{Theta}))}$$

$$I = 1 + N(1 - R\sin(\text{phi}))$$

$$J = 1 + N(1 + R\cos(\text{phi}))$$

Within the transformation process, the points on the hemisphere are transposed downward into cells on a two-dimensional area, such as a plane. The size of the cells determined from the partition number N is important, as shown in the following example. Consider a population constituted as follows:

n time series of seemingly random real numbers, hereafter called "offset data", n sets of real numbers, hereafter called 'orientation data', an association scheme linking individual members of those series, hereafter called 'time' or 'depth' indifferently, and an algorithm deriving numbers Theta, hereafter called 'magnitude', and Phi, hereafter called 'azimuth', from any pair of the offset data and its associated orientation data at its associated depth.

The process represented by the above example defines a corresponding cell in the equal area partition. A sample of size 'p' is selected out of the population and is carried through the sample. At every step, a pair of numbers I and J are generated designating a cell of the map, and in each cell, the number of times it has been designated is accumulated ending with a map of frequency of occurrence of cells, which closely resembles a map of density of probability of occurrence of the dip values corresponding to those occupied cells. Thus, a graphic depiction of the complex geometrical relations of multiple bedding planes is made. Sample size 'p' is chosen large enough to allow the sample distribution to approximate the population distribution, yet small enough not to exceed the population variability. In current use a sample size of about 5 ft to 10 ft of surveyed borehole is used out of which no more than one dip symbol per foot is reported to the user. Given the completed equal area map, according to the above described process, a "neighborhood" evolves as any plurality of occupied cells such that a way exists to pass from one to the other without crossing an empty cell or 'street'. This definition excludes single cells, even though they can represent recurrent dip values. Thus, defined neighborhoods are dependent on the partition number N. Too large a partition number will destroy all neighborhoods, while too small a number would aggregate all occupied cells into too few or even a single neighborhood. A partition number, defined by the user, of from about 10 to about 100 can be used. The neighborhood selection process regards dip as the material expression of a random function obeying a spatial law of probability of occurrence. Certain areas of the hemisphere are thus presumed to have a higher probability of containing the formation's dip. The equal area map shows the density of this probability, and the processing system defines the areas of higher density.

From the list of offsets and r-values produced by the correlation process (with substantial mutual overlap between successive rounds) sequences are arbitrarily selected, as described previously. From any pair of intersecting correlations, a valid dip is determined (according to the process outlined within the section dealing with Aperture) from its weight from contributing r-values. The cell addresses of this dip are then determined (as outlined above), and a trial group number, the arbitrary sequence number of the dip within this analytical interval, is attached to the record containing the cell addresses. The weight of this dip is also added to this record. At this point, the analysis section has produced a record containing an arbitrary sequence number, the dip weight, a pointer to maintain the original entry number, and one entry per classification (one cell number per dimension on which the user has elected to have the analysis proceed). Taking the first dip as the standard, all the other dips within the matrix are examined to see if any other dip is a "neighbor" of the standard. A neighbor, in this case, can be determined by subtracting the n cell entries from the classification process of the standard from the corresponding cell entries of the second dip, resulting in an integer vector of length n. If all the entries within this vector are zero, the two dips are in the same cell and are considered neighbors. Taking the absolute value of this vector, if no entry is greater than 1, the two dips are neighbors. If the dips are neighbors, then the integer sequence numbers are examined; the lower of the two sequence numbers is posted in both records (this process is known within the implementation as a "swap"). This examination is repeated over all the dips within the analyis interval. Having used the first dip as the standard, the second dip is taken as the standard, and the process above is repeated. When all of the dips in the classification interval have been used as the standard, this interaction of the process is complete.

Having completed comparing all the dips to all the other dips within the matrix, the number of "swaps" is examined. If this number is zero, the process terminates; otherwise, the first dip is again taken as the standard and another iteration is taken until the number of swaps is zero. Since the lower cell number is being propagated throughout the matrix, in theory the number of swaps must go to zero at some point; in practice, no more than 8 iterations have occurred, even for very poorly defined matrices, although a very large number is certainly possible for large matrices with elongated groups. Since this is a time consuming process, the program checks the iteration number each time, if it exceed 50, the program abends.

To limit the number of possible checks to be done, the comparison sequence within each iteration is altered slightly so that before the iteration starts, the records are sorted on the first cell entry number. The first cell is taken as the standard and each succeeding cell in the sorted matrix is examined, as above. This process continues, noting "swaps" as appropriate, until the standard and the current record are more than one entry removed on the variable, which was the sort key. Obviously, the selection process can terminate at that point since none of the remaining cells in the sorted list can be a neighbor of the current standard. Then, as before, the second entry is taken as the standard and the process repeated until all entries have been used as the standard. Then the resulting matrix is sorted on the second variable, classified, sorted on the third variable, classified, etc., until all the variables have been used as the basis of a sort. At this point, the number of "swaps" arising from all this process is examined, and the routine process, as above.

When this process terminates, arbitrary cell numbers have been propagated throughout the matrix. Records which are neighbors have the record number of the lowest entry in the group, and records which have no neighbor have the entry number with which they started.

This grouping method is not only insensitive to the number of dimensions involved, it is also insensitive to the values in the classification cell entries. Positive numbers, negative numbers, and even floating point numbers can be used with any range that can be represented on the computer in use. The rountine checks to see if any other element in the classification matrix is more than one classification element removed from the current entry. The records are then examined, and a cross-reference system determines the number of cells in each group, the total weight of the group, the number of entries in each group, and other items to be used later. The total weight of each neighborhood is then determined; the neighborhood density is calculated for each neighborhood, as outlined below, and the neighborhood density is then inserted into the entry in the matrix where the individual dip weight had been stored. This matrix is then stored in descending order on the density value. This means that the cell entries from the most dense neighborhood will be at top of the matrix. The group numbers for the densest neighborhood are renumbered from the arbitrary number returned by the classification process to one; the next most dense entries are numbered two, three, etc., until the records have been renumbered. Since this is simply a sequence number, the routine can have any number of groups, with the limit being the case where no cell entry is adjacent to any other entry, and the total number of groups equals the total number of entries.

Patterns of dips are useful in dipmeter interpretation, as is well-known to those skilled in the art, and such patterns form elongated neighborhoods on the equal area map. An important advance of the present invention over prior art systems is the ability to identify such elongated neighborhoods provided by the process described above. Prior art schemes were oriented to retrieve neighborhoods of only rectangular outline, thus providing an interpretation that was flawed geologically. In the present invention, after the ranking step, each correlation level is inspected in sequence, and a search is made of all the dip determinations within this level that contributed to the neighborhood of highest rank. In most cases at least one contributor is found and is produced as the dip for the level.

If more than one contributor is found, a vector average, conveniently weighted, is formed and produced. If no contributor is found, then contributors to the second ranking neighborhood are called, and the same process is repeated until all correlation levels have thus been inspected and each has produced a result, if any, which is presented to the user, as described below. It is, in fact, possible that a level sent no contribution to any of the neighborhoods of the selection or that the selection produced no neighborhood at all. If this occurs, the dip for that level is set as a missing data item.

Quality (Optional)

The optional quality indication process is in two parts: evaluation of the neighborhood ranks within the sample interval and evaluation of the dip weights at each level.

To rank a neighborhood, a density measure is calculated:

$$\text{Density} = \frac{(\text{Sum of the weighted dips within the neighborhood})^{**2}}{(\text{Number of cells in the neighborhood})}$$

The neighborhoods are then ranked according to density, as was described earlier, with the densest neighborhood given the rank 1, and the rest in descending order. The density values of each neighborhood are then divided by the density value of neighborhood number 1. This attaches to each neighborhood a relative weight, so neighborhood number 1 always has a weight of 1.0.

The lowest ranking neighborhood is identified, and at each depth level, the vector sum of weighted dips contributed to this neighborhood is calculated. The magnitude and azimuth of that sum are then reported to the user as the dip at this depth. The second part of the quality rating evaluates how "good" is the selected dip reported for each level within the neighborhood interval. Each reported dip is the vector sum of all the weighted dips on that level and falling into the neighborhood of lowest rank. For instance, at a given level, three dips can fall in the neighborhood of second rank, but none in the neighborhood of first rank, and these three will be selected, while any others falling in neighborhoods of high ranks will be ignored.

The sum of the weights of those dips is divided by the total potential weight, i.e., three times the number of possible valid dips in the level. Dips are regarded as valid if they belong to intersecting pairs of vectors. This ratio is in turn multiplied by the ratio of the weight of the neighborhood to three times the number of neighborhood dips:

$$\text{Level Quality} = \frac{\text{Weight of Dips from Lowest Ranked Neighborhood}}{\text{Number of Dips at This Level Times Three}} * \frac{\text{Weight of the Lowest Ranked Neighborhood At This Depth Level}}{\text{Total Number of Neighborhood Dips in Neighborhood Interval Times Three}}$$

This rating in effect ignores dips which fail to fall in neighborhoods and compares those which do between themselves.

The final weight is the product of the relative neighborhood density by the square root of the level quality value, multiplied by 99, i.e., dip Quality = relative neighborhood density * level quality * 99.0.

The dip quality can be displayed by different color shades, color density, or by different "tadpole" dip symbols, as is known in the art.

Process Overview

Figure 5:
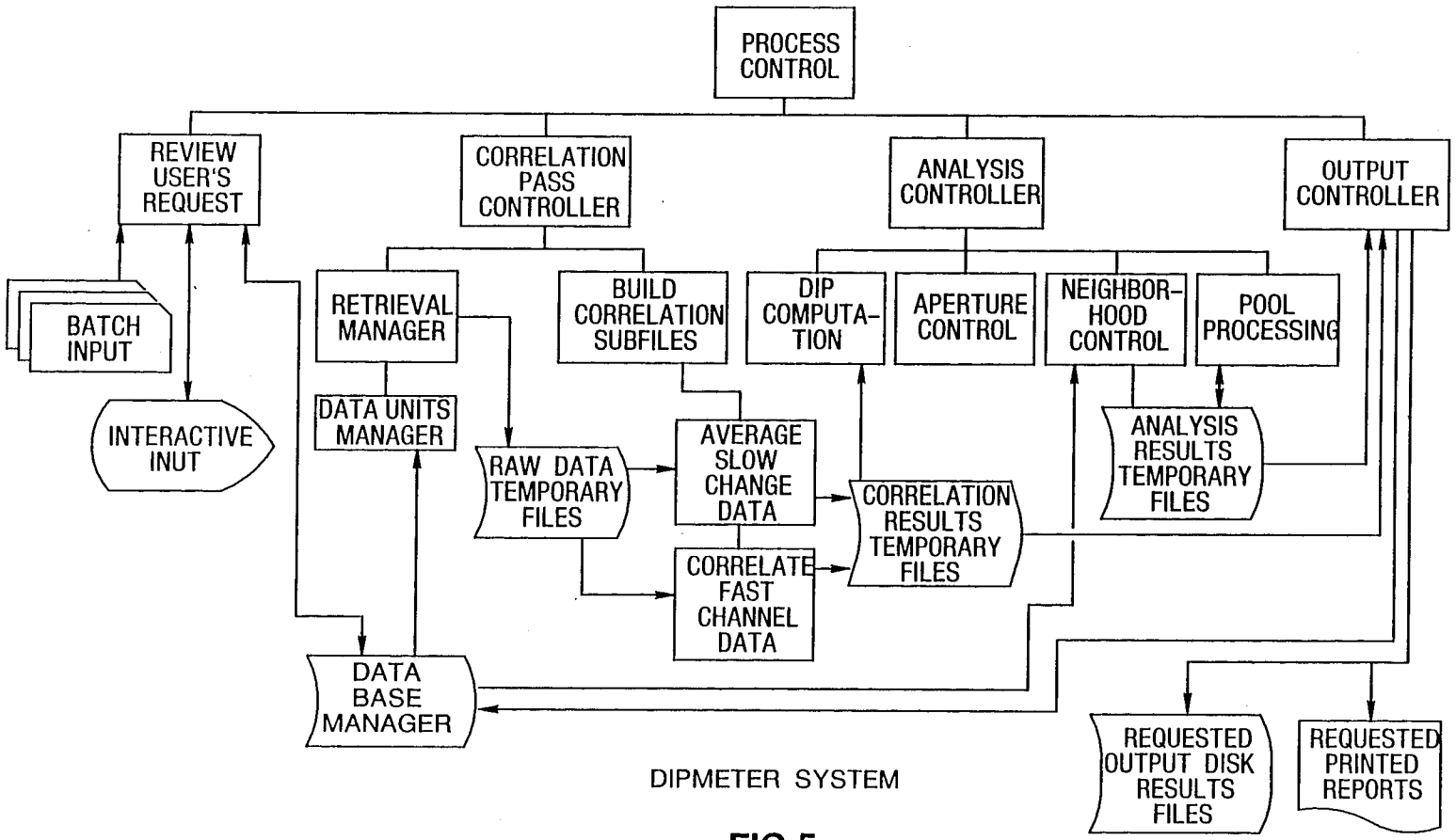
FIG. 5 is a schematic diagram of a process system embodying the present invention.

FIG. 5 is a schematic diagram illustrating the process of one embodiment of the present invention. The major process blocks will be described below. "Process Control" is responsible for general program execution, such as checking the return codes from the various sections, allocating disk work space, cleanup after the program finishes execution, and to call the other routines and check return codes.

"Review User's Requests" is responsible for checking the user's input, either from batch card decks or from an interactive terminal, for syntactical correctness and verifying that the analysis requested agrees with other stored data. It also determines if there is enough disk space available for program execution and sets up parameter blocks to control the other sections of the program based on the user's request.

"Correlation Pass Controller" is responsible for executing the number of correlation passes through the raw data requested by the user. It defaults to a single pass but can be repeated as often as needed. For each pass, all the data is retrieved from the database and written to subfiles; the correlations are computed, and the average data and offsets written to temporary files for use in the analysis section.

"Retrieval Manager" obtains the data from the database and transforms it as program work files. The "Retrieval Manager" is responsible for checking that the units of measurement are correct, transforming them if the units are incorrect, making sure that there are not too many missing data points for the program to execute, and generally verifying that the raw data are in condition for suitable analysis. This section also is responsible for the creation of required data files if they must be calculated from other input or from other curves in the database.

"Build Correlation Subfiles" averages, for each process pass, the signals over the correlation interval, constructs the correlogram for each correlation, picks the peak from it, and writes a record on a work file for each correlation containing all these items. This section also is responsible for conducting validity checks on the correlogram. Currently, these are done by computing the standard deviation during the correlation process. If the standard deviation for a given window or a given correlation, is less than a given cut-off, the program assumes that the tool sensor was not in contact with the wellbore and disregards the correlation.

"Analysis Controller" operates on the results of the correlation section as a unit to lump all the offsets from the correlation section together, no matter how many passes were used to produce them, and construct dips from all possible combinations of offsets. There is no attempt to preselect vector combinations or to check vectors for consistency.

"Dip Computation" computes dips from a particular combination of vectors using one peak on the correlogram from each vector's set of peaks.

"Aperture Control" reviews the output from each dip computation, and if the output indicates that the two vectors are colinear, the routine returns missing data for this set and proceeds. If it is a valid combination of vectors, the computation is checked against the area indicated by the user as acceptable. If it is, the current point is accepted as valid; if not, another combination of offsets is tried until all possible combinations have been tied.

"Neighborhood Control" reviews the output from the "Aperture Control" section. When the "Aperture Control" section has computed dips over an analysis section, all of these dips are processed, as outlined in the analysis section, to produce one dip per requested depth, together with a quality factor indicating how good an estimate this dip is of the subsurface bedding.

"Pool Processing" is an option that reviews the dips at a given depth to see if the dips around a chosen one are similar (for example, within 3.5° of arc). The arc distance varies inversely according to the overlap percentage and is intended to produce one dip for each feature within the curves being correlated. This section was developed because of consideration of the fact that offsets (and therefore the dips produced from them) are largely determined by striking movements on the recorded curves. If a given feature is contained within several windows, several identical offsets can be produced. "Pool Processing" attempts to identify this situation, and when it does, it combines the dips across these depths to produce one dip with a quality reading equal to the sum of the component dips.

"Output Controller" is responsible for reading the subfiles output by the analysis section and loading the results of the analysis into the database. The dips, including the quality indications, are then output as a display, such as computer files, computer tapes, hardcopy reports or logs, and monochrome or multicolor visual displays.

Wherein the present invention has been described in particular relation to the drawings attached hereto, it should be understood that other and further modifications apart from those shown or suggested herein, may be made within the scope and spirit of the present invention.

We claim:

1. A dipmeter signal processing method, comprising:

(a) for each of a plurality of depths correlating intervals of at least three dipmeter signals to derive a plurality of possible offsets;

(b) for each of the offsets, defining the spatial coordinates of an associated vector parallel to an implicit bedding plane, and utilizing the coordinates to combine each possible combination of nonparallel vectors for a given depth to generate a plurality of dips;

(c) retaining only those dips that substantially repeat for a given depth or repeat from one depth level to the next within a given depth zone to retain a single dip for each depth; and (d) outputting a display of the dip for each depth.

2. The method of claim 1, wherein the correlation intervals are overlapping.

3. The method of claim 1, wherein step (a) comprises:

(i) correlating a preselected base segment of one dipmeter signal to a segment of equal length on a second dipmeter signal to generate a numerical evaluation of the correlation, (ii) repeating step (i) within a search length on the second dipmeter signal to develop a correlogram, and (iii) retaining at least one peak on the correlogram, each peak corresponding to an offset.

4. The method of claim 1 and including between steps (b) and (c):

selecting pairs of offsets that generate dip vectors within a selected range of values.

5. The method of claim 4, wherein the filtering comprises retaining those dips corresponding to the highest correlation value that come within a selected range of values selected from the group consisting of dip azimuth, dip magnitude, and search angle.

6. The method of claim 1, wherein step (c) comprises:

(i) assigning a numerical evaluation of the relative quality of each dip, (ii) determining groupings of dips in a defined space, (iii) discarding dips within a depth zone that do not fall within a grouping of dips, (iv) evaluating the groupings of dips by total relative quality of the dips within each group and the size of each group, and (v) retaining a single dip for each depth from the highest evaluated grouping of dips.

7. The method of claim 6, wherein step (i) comprises assigning a quality rating to each dip based upon a correlation number from each offset contributing to the dip.

8. The method of claim 6, wherein step (ii) comprises: transforming dips to points on a hemispherical surface and projecting the points into equal area cells on a plane.

9. The method of claim 1, wherein step (d) includes providing an indication of the quality of the dip.

10. The method of claim 9, wherein the quality of the dip is based upon a correlation number from each offset contributing to the dip.

11. The method of claim 1, wherein the spatial coordinates are associated with the location of each electrode within a wellbore that produced the signals.

12. The method of claim 11, wherein the configuration of a dipmeter tool is utilized used to generate the signals to define the spatial coordinates.

13. An apparatus for dipmeter signal processing, comprising:

means for correlating intervals of at least three dipmeter signals to derive a plurality of possible offsets for each of a plurality of depths;

means for defining for each of the offsets the spatial coordinates of an associated vector parallel to an implicit bedding plane;

means for utilizing the coordinates to combine nonparallel vectors to generate a plurality of dips;

means for retaining only those dips that repeat for a given depth or repeat from one depth level to the next within a given depth zone to retain a single dip for each depth; and means for outputting a display of the dip for each depth.

* * * * *